United States Patent [19]

Tateishi

[11] Patent Number: 4,658,903

[45] Date of Patent: Apr. 21, 1987

[54] METHOD FOR HANDLING WELLHEAD ASSEMBLY

[75] Inventor: Hiromitsu Tateishi, Tokyo, Japan

[73] Assignee: Mitsui Ocean Development & Engineering Co., Ltd., Tokyo, Japan

[21] Appl. No.: 799,805

[22] Filed: Nov. 20, 1985

[51] Int. Cl.[4] ..... E21B 7/128

[52] U.S. Cl. ..... 166/335; 166/358; 175/7; 405/196

[58] Field of Search ..... 166/335, 358; 175/7, 175/9; 405/196, 197, 198, 199, 200, 203, 204, 205

[56] References Cited

U.S. PATENT DOCUMENTS

| | | | |
|---|---|---|---|
| 3,996,754 | 12/1976 | Lowery | 405/197 |
| 4,456,404 | 6/1984 | Evans | 405/196 |
| 4,492,270 | 1/1985 | Horton | 405/204 |
| 4,493,591 | 1/1985 | Francis, Jr. | 405/198 |

*Primary Examiner*—Stephen J. Novosad
*Assistant Examiner*—William P. Neuder
*Attorney, Agent, or Firm*—Bierman & Muserlian

[57] ABSTRACT

A method for handling an underwater wellhead assembly by means of an offshore jack-up drilling rig or platform wherein the wellhead assembly is prepared on the shore or quay and is carried on the drilling rig to a preselected drilling location and lowered down therefrom to the ocean floor.

1 Claim, 8 Drawing Figures

METHOD FOR HANDLING WELLHEAD ASSEMBLY

BACKGROUND OF THE INVENTION

1. Field of the Invention

The present invention relates to a method for handling wellhead structures, and especially to a method for transporting underwater wellhead assemblies to an offshore jack-up drilling rig or oil-production platform and installing it on the ocean floor.

2. Description of the Prior Art

In recent years it has become desirable to use offshore jack-up drilling rigs or barges from which to drill wells in marine locations. The jack-up drilling rig consists of a buoyant platform which is provided with a number of legs extending through the platform vertically and can be moved up and down in a vertical line by jacking or lifting systems consisting of the jack arranged on a longitudinal side of the leg and the pinion mounted on the platform to engage with the pinion. In the rig of this type which will be referred to as a "jack-up-rig", the legs are lifted up out of the surface of the water and the buoyant platform is usually towed to a preselected offshore drilling location by, for example, a tug boat or boats, the legs are then lowered down to the ocean floor and the platform is raised up above the surface of a body of water so that it can be fixed and supported on the ocean floor. When carrying on a multi-well drilling operations in the ocean, a subsea template having a plurality of receptacles therein is set on the ocean floor, and holes are drilled through some of these receptacles. In drilling oil and gas wells in the ocean floor in depths up to approximately 90 meters, the jack-up-rig may usually be operated by using a subsea wellhead assembly and a surface blowout preventer extending above the surface of a body of water for safety and reliability. However, in drilling the ocean floor in depths of water greater than about 120 meters or under hostile environmental conditions such as strong wind and severe sea conditions, the jack-up-rig must employ a subsea blowout preventer and a subsea wellhead assembly. In practice, these wellhead assemblies are positioned in depths of water greater than the depth at which a diver can safely and readily work. Furthermore, the base member which is a horizontally-extending frame called a "template" is for example, about 24 meters in length, about 6 meters in width and more than 140 tons in weight. Such a heavy and cumbersome structure is impossible to carry or transport on the vessel type or semi-submersible drilling barge.

Consequently, the template has been handled by, for example, crane barges or derrick cargo barges separate from the drilling barge. This is very expensive and requires a number of means for lowering the template down to the ocean floor and bringing the drilling barge to its correct position with respect to the anchored template.

OBJECTS OF THE INVENTION

In the light of the above and the necessity for using the jack-up-rig under a severe condition of deep sea, a main object of the present invention is to provide a method for handling an underwater wellhead assembly by the jack-up-rig.

It is another object of the present invention to provide a method for mounting and carrying an underwater weelhead assembly and a template on the jack-up-rig.

It is a still further object of the present invention to provide a method for installing a wellhead assembly by the jack-up-rig on the ocean floor at a preselected drilling location.

BRIEF DESCRIPTION OF THE DRAWINGS

These and other objects of the present invention will be understood from the following description taken with reference to the drawings, wherein.

DETAILED DESCRIPTION

Figure 1:
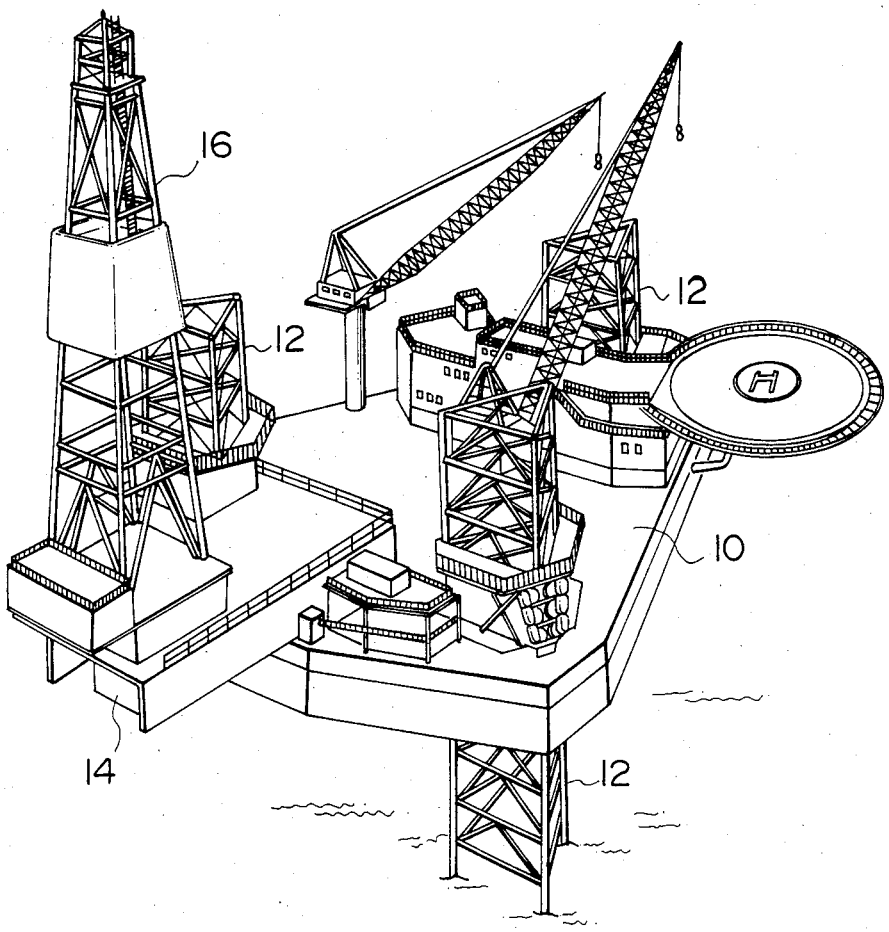
FIG. 1 is a schematic perspective view of the jack-up-rig for carrying out a method for the invention.
Figure 2:
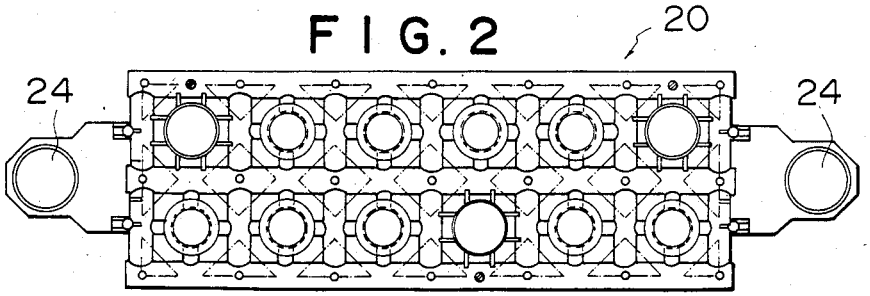
FIG. 2 is a plane view of a template which is a part of a underwater wellhead assembly.
Figure 3:
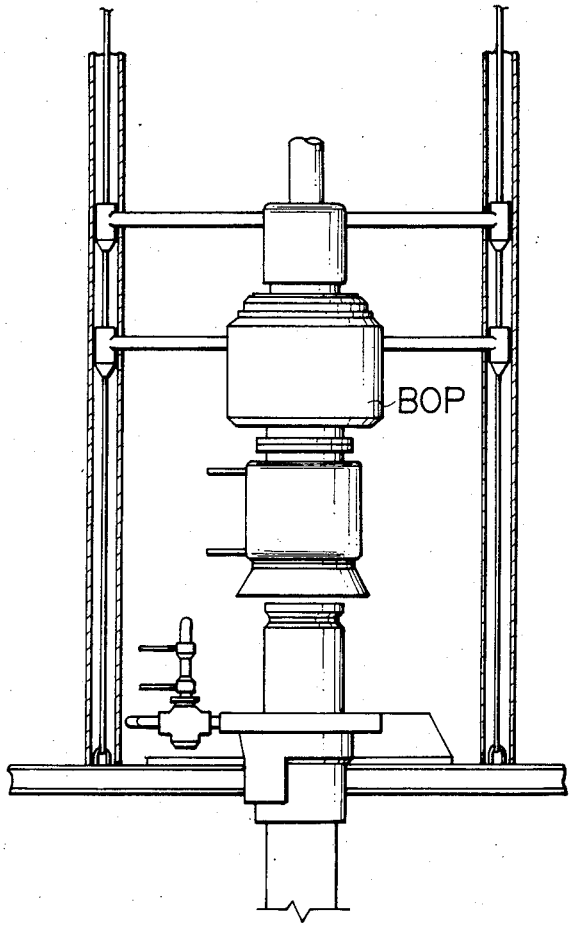
FIG. 3 is a schematic view of a blowout preventer to be mounted on the template.

Referring now to the drawings, a schematic diagram of FIG. 1 shows a drilling platform or barge of a jack-up-rig type which is generally designated by the reference numeral 10 which is provided with at least three legs 12. Each leg 12 is extended vertically through the platform 10 provided with a cantilever working deck 14 which may be slid horizontally along it and projected therefrom. Mounted on the cantilever working deck 14 is a tower 16 provided with several pieces of equipment such a drilling machines and winches or draw works.

The legs 12 of the rig 10 are lifted up from the surface of a body of water so that the plaltform 14 may buoy it up and may be towed by tug boats to a preselected drilling location at which each of the legs 12 is lowered down to the ocean floor, and then the platform 14 is lifted up to a desired height from the surface of water, the cantilever working deck 14 being moved from its original position to the outboard of the platform for the desired drilling operations.

In carring out drilling operations using the jack-up-rig 10, a template 20 must be positioned on the floor of the sea in the same manner as with other type of barges.

According to the present invention, the template 20 provided on the shore or quay 30 for the purpose of placing it on the ocean floor is carried on the platform 10 and transferred therewith from the quay 30 to a preselected drilling location.

Figure 4:
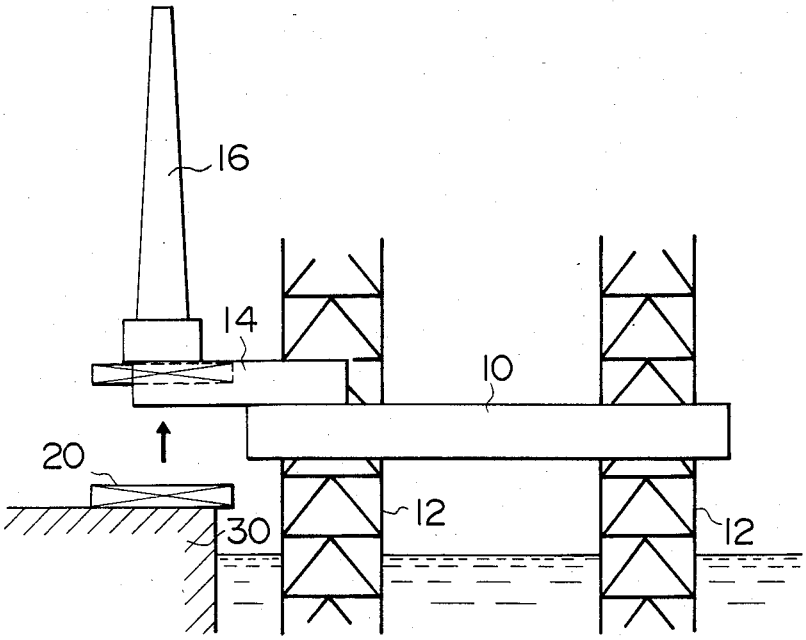
FIG. 4 through FIG. 8 are respectively a schematic view illustrating steps for carrying out the method of the invention.

As shown in FIG. 4, to mount the template 20 on the platform 10, it is brought alongside the quay 30 at which the template 20 is prepared, the legs 12 of the platform 10 are lowered down to the ocean floor, and the platform 10 is lifted up to a desired height from the surface of a body of water. Then the cantilever working deck 14 is extended from the stern of the platform 10 to over the template 20 lying on the quay 30. The template 20 is lifted up to the underside of the cantilever deck 14 by any suitable means such as winches and cables.

Figure 5:
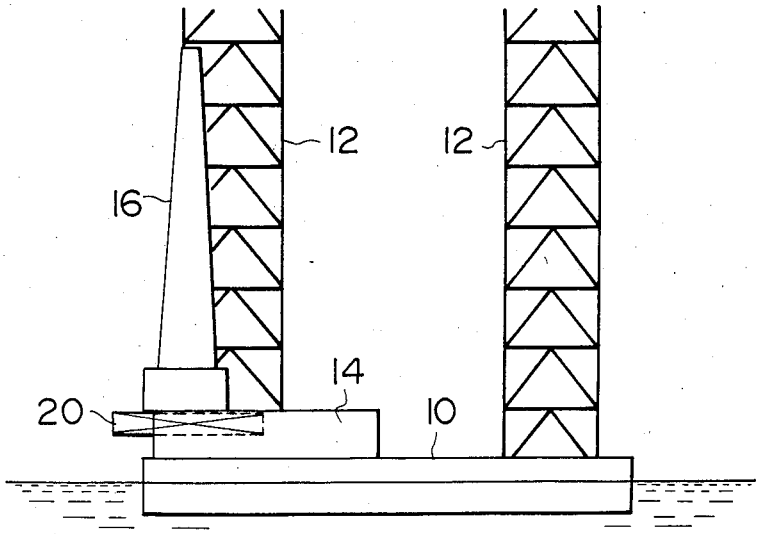
Figure 6:
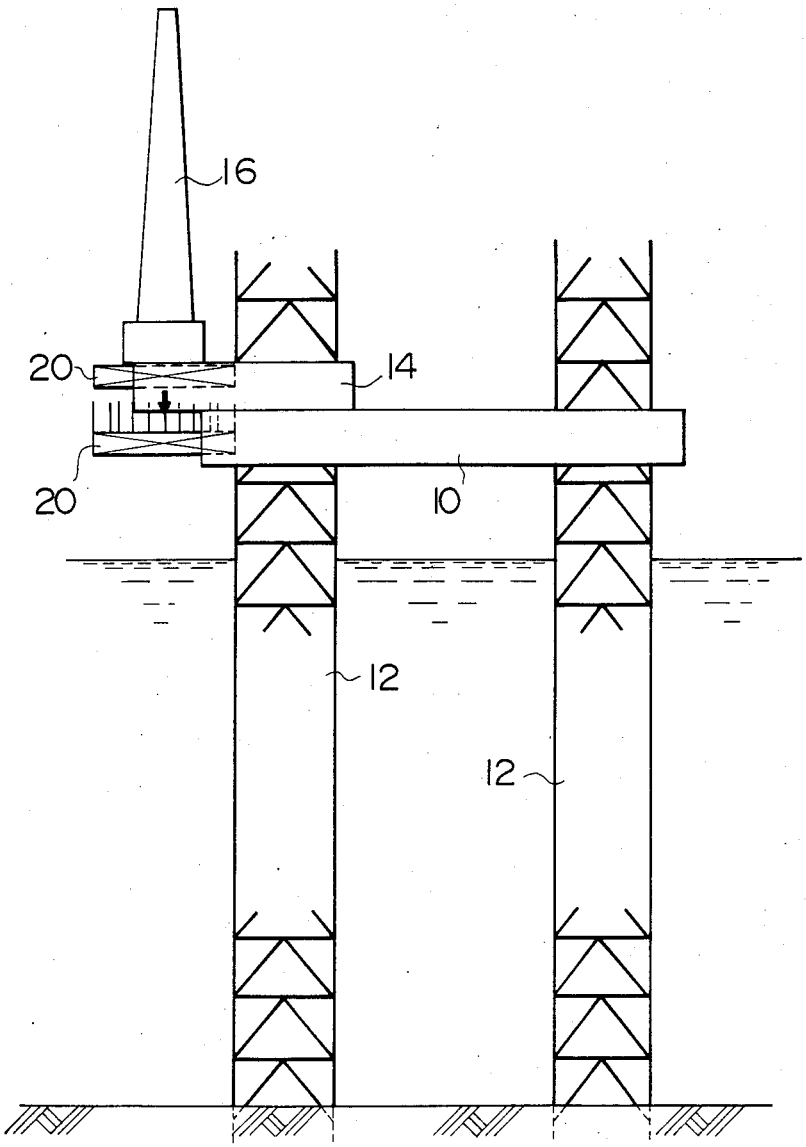
Figure 7:
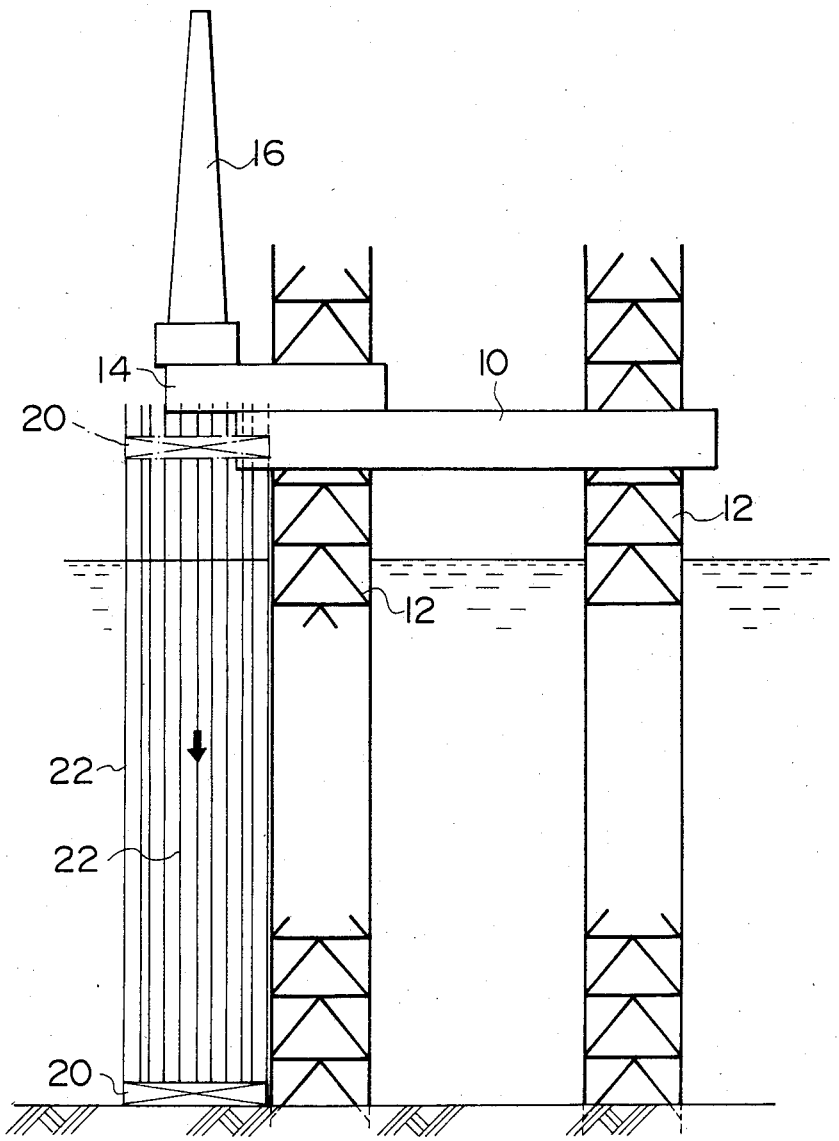
Figure 8:
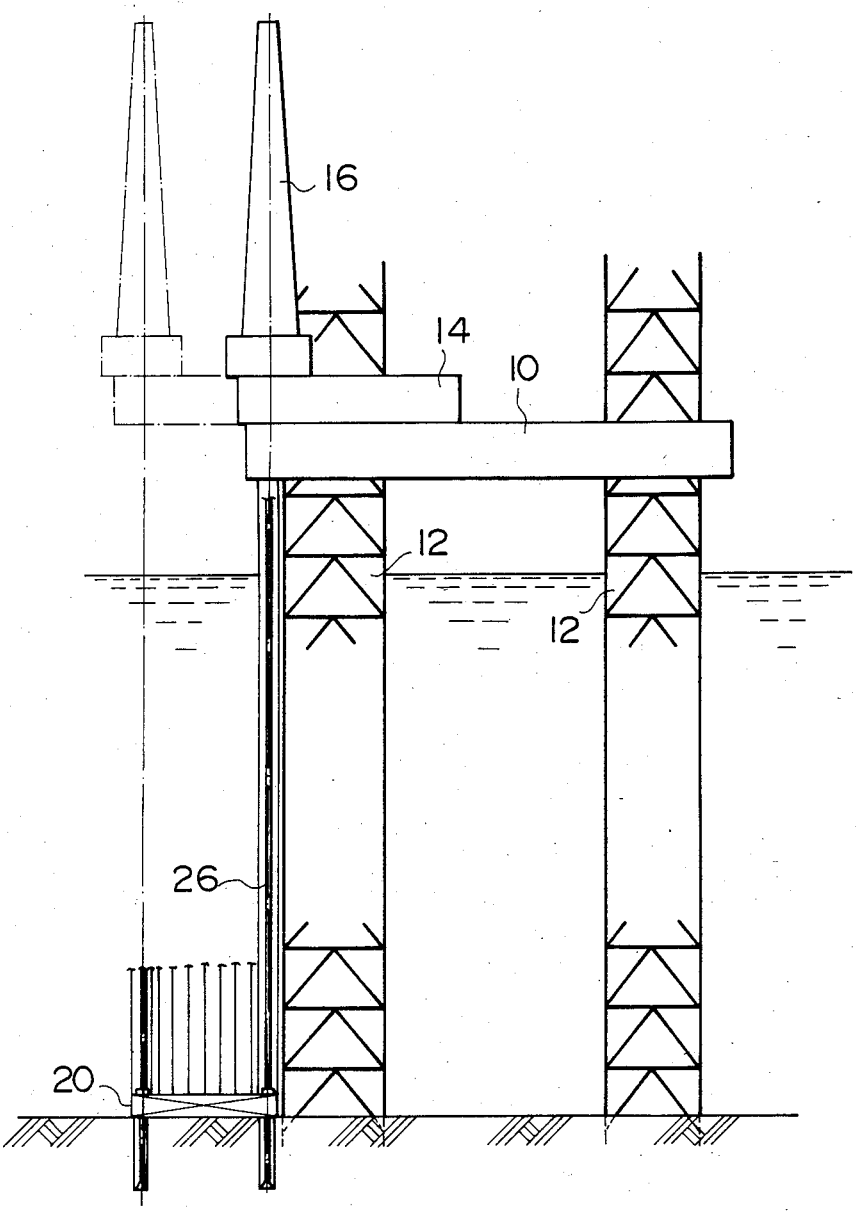

Then, as shown in FIG. 5, the cantilever working deck 14 carrying the template 20 is returned back from the extended position to its original position within the stern of the platform 10, and the template 20 may be housed therein or in the main deck, the legs 12 being lifted up from the ocean floor so that the platform 10 may be floated on the surface of a body of water and towed by boats to a preselected drilling location.

When the platform 10 carrying the template 20 thereon has arrived at the preselected drilling location, the legs 12 are lowered down to the ocean floor and then the platform 10 is lifted up to a desired height from the surface of a body of water. Then the cantilever working deck 14 is extended from the stern of the platform 10 together with the template 20 so that the template may be set into just above a desired position to be fixed on the ocean floor.

To keep the template in the cantilever or on the main deck, it may be stored without using overdimensional out fittings such as wire guide posts and overhang guide posts. Such outfitting works may be carried out when the template is located at a main deck level on the way to lowering it to the ocean floor.

After the template 20 has been moved down to a desired position, it is leveled through template leveling receptacles and guide posts and the guide posts have been piled through guide post receptacles 24. Either a conductor pipe is fixed to the ocean floor for surface drilling or a subsea blowout preventer BOP is carried on the template 20 for subsea drilling.

According to the method of the invention, as is obvious from the foregoing, the transportation and installation of the template 20 can readily be made without using crane barges or derrick cargo barges which are very expensive.

Further, according to the present invention, the subsea blowout preventer BOP can be installed for subsea drilling operation.

While a preferred embodiment has been desacribed, variations thereto will occur to those skilled in the art within the scope of the present inventive concepts which are delineated by the following claims.

What is claimed is:

1. A method of handling an underwater assembly by an offshore jack-up drilling rig having a plurality of legs and a cantilever working deck slidably mounted on a platform thereof comprising steps of:

(a) lowering down said legs to the ocean floor at a position adjacent to a template provided on shore, lifting up said jack-up drilling rig above the surface of a body of water, extending said cantilever working deck from said rig to over said template provided on the shore;

(b) mounting said template on the underside of said cantilever working deck and returning said working deck together with said template back to the original position within said jack-up drilling rig;

(c) lifting up said legs from the surface of a body of water and towing said rig to a preselected drilling position;

(d) lowering down said legs from said rig to on the ocean floor and lifting up said platform above the surface of a body of water;

(e) extending said cantilever working deck together with said template from said platform to over the surface of a body of water; and (f) lowering down said template to on the ocean floor.

* * * * *